US005458755A

United States Patent [19]

Fujiyama et al.

[11] Patent Number: 5,458,755

[45] Date of Patent: Oct. 17, 1995

[54] ANODIZATION APPARATUS WITH SUPPORTING DEVICE FOR SUBSTRATE TO BE TREATED

[75] Inventors: Yasutomo Fujiyama, Atsugi; Mitsuhiro Ishii, Fujisawa; Senju Kanbe, Kawasaki; Takao Yonehara; Toru Takisawa, both of Atsugi; Akira Okita, Ayase; Kiyofumi Sakaguchi, Atsugi; Takanori Watanabe, Atsugi; Kazuo Kokumai, Atsugi, all of Japan

[73] Assignee: Canon Kabushiki Kaisha, Tokyo, Japan

[21] Appl. No.: 148,341

[22] Filed: Nov. 8, 1993

[30] Foreign Application Priority Data

| | | | |
|---|---|---|---|
| Nov. 9, 1992 | [JP] | Japan | 4-322295 |
| Jan. 6, 1993 | [JP] | Japan | 5-000732 |
| Jan. 18, 1993 | [JP] | Japan | 5-021637 |
| Mar. 23, 1993 | [JP] | Japan | 5-086876 |
| Mar. 31, 1993 | [JP] | Japan | 5-095011 |
| Apr. 27, 1993 | [JP] | Japan | 5-122077 |
| May 14, 1993 | [JP] | Japan | 5-135117 |

[51] Int. Cl.[6] ..... C25D 17/06; C25D 21/00

[52] U.S. Cl. ..... 204/224 R; 204/237; 204/238; 204/277; 204/279; 204/256; 204/258; 204/270; 204/297 R; 204/265

[58] Field of Search ..... 204/256, 258, 204/270, 277, 279, 265, 297 R, 297 W, 224 R, 237–238; 134/32

[56] References Cited

U.S. PATENT DOCUMENTS

| | | | |
|---|---|---|---|
| 2,737,488 | 3/1956 | Gray | 204/279 X |
| 2,801,965 | 8/1957 | Monahan | 204/297 W |
| 3,536,603 | 10/1970 | Bonga | 204/297 R X |
| 3,720,595 | 3/1973 | Kohler | 204/277 X |
| 3,835,017 | 9/1974 | Mentone et al. | 204/224 R |
| 4,430,179 | 2/1984 | Ford et al. | 204/265 X |
| 4,605,483 | 8/1986 | Michaelson | 204/277 X |
| 4,849,084 | 7/1989 | Vouzellaud | 204/277 X |
| 4,898,653 | 2/1990 | Morris | 204/265 X |

FOREIGN PATENT DOCUMENTS

| | | | |
|---|---|---|---|
| 1183754 | 7/1959 | France | C23D 17/08 |
| 2315028 | 1/1977 | France | B66C 1/46 |
| 578054 | 7/1976 | Switzerland | C25D 17/00 |

*Primary Examiner*—Donald R. Valentine

*Attorney, Agent, or Firm*—Fitzpatrick, Cella, Harper & Scinto

[57] ABSTRACT

An anodization apparatus for anodizing the surface of a semiconductor substrate by supporting the semiconductor substrate between a pair of electrodes in an electrolytic solution and applying a voltage across the pair of electrodes. The anodization apparatus includes an elastic sealing member for supporting a peripheral portion of the semiconductor substrate such that a surface portion of a semiconductor substrate remains exposed, a support jig which includes a tapered hollow portion for supporting the sealing member, and a device for introducing a fluid of gas or liquid into the tapered hollow portion. When the fluid is introduced, the sealing member is pressed against and brought into hermetic contact with the tapered hollow portion and with the entire peripheral portion of the semiconductor substrate such that the electrolytic solution is separated into electrically isolated parts by coordination between the semiconductor substrate, the sealing member, and the support jig. Anodization of the semiconductor substrate may then be carried out, such as by producing a porous silicon layer on the surface of the semiconductor substrate.

8 Claims, 7 Drawing Sheets

ANODIZATION APPARATUS WITH SUPPORTING DEVICE FOR SUBSTRATE TO BE TREATED

BACKGROUND OF THE INVENTION

1. Field of the Invention

The present invention relates to a supporting device for a substrate which supports a substrate to be treated (hereinafter referred to simply as "treated substrate") in a treating solution, and an anode formation (anodization) apparatus provided with it.

More specifically, the present invention relates to an apparatus for anodization of a crystalline silicon layer used in the field of formation technique of SOI (silicon on insulator) which is utilized in ULSI including Bi-CMOS device with both low dissipation power and high-speed operation, three-dimensional structure device including layered functional elements such as a sensor device, an arithmetical element, a memory, etc., or a high-voltage device such as a power transistor for electronic switching system, discharge printer, or plasma display, and in the field of micro machining technique, etc. Particularly, the present invention relates to an anodization apparatus used in producing porous silicon.

Here, "porous silicon" in the present invention means a crystalline silicon having a single crystal structure and at the same time having many pores therein.

Further, a term "crystalline silicon substrate" in the present invention means a silicon single crystal wafer having no pores, which is utilized in the field of semiconductor industries.

RELATED BACKGROUND ART

Recently, semiconductor devices using porous silicon have been widely researched.

Formation of porous silicon was found by A. Uhlir and D. R. Turner in the course of study for electrolytic polishing of silicon single crystal which was biased in a positive potential in a hydrofluoric acid (hereinafter referred to simply as "HF") aqueous solution.

Then, an attempt was made to utilize the high reactivity of porous silicon for an isolation step of elements, which requires a thick insulator formed between elements, in producing a silicon integrated circuit. As a result, application techniques were developed to FIPOS (Full Isolation by Porous Oxidized Silicon), which is a complete isolation technique of IC by a porous silicon oxidized film, and to a silicon direct bonding technique, in which a silicon epitaxial layer grown on a porous silicon substrate is adhered onto an amorphous substrate or onto a silicon single crystal wafer substrate through an oxidized film.

Inventors of the present invention have been already proposed an anodization apparatus having the structure as shown in a cross section in FIG. 8 as pore-etching apparatus for crystalline silicon utilizing an anodization reaction.

In FIG. 8, reference numeral 1 denotes a degenerated crystalline silicon substrate as a substrate to be treated (treated substrate), 2 a formation tank made of a tetrafluoroethylene resin (trade mane: Teflon), 3*a* and 3*b* platinum electrode plates to which a voltage is applied from an external direct current (DC) power source (not shown) to constitute negative and positive electrodes, respectively, 4 a substrate support jig made of a tetrafluoroethylene resin (trade name: Teflon) constituting substrate support means, 5 a sealing member for substrate made of a tetrafluoroethylene resin (trade name: Goatex) having flexibility, elasticity and hermetic property, 11*a* and 11*b* bodies of electrolyte, which is a hydrofluoric acid mixture solution, and 15 a Goatex sealing member for the substrate support jig, which maintains a hermetic contact between the formation tank 2 and the substrate support jig 4.

Further, FIG. 9A is a perspective view to illustrate constituent elements in the conventional substrate support jig 4 shown in FIG. 8, and FIG. 9B a perspective view to show an assembled state of the support jig 4. In FIGS. 9A and 9B, numerals 4*a* and 4*b* represent segments of the substrate support jig, which can be separated from each other so that the crystalline silicon substrate 1 can be readily mounted to or dismounted form the jig.

Numerals 5*a* and 5*b* represent segments of the substrate sealing member made of Goatex, which are set in grooves inside the substrate support jig segments 4*a*, 4*b*, respectively, to maintain the hermetic condition between the substrate support jig segments 4*a*, 4*b* and the crystalline silicon substrate 1. They are divided in the same manner as the substrate support jig segments 4*a*, 4*b* are.

Crystalline silicon substrates used in semiconductor industries are normally subjected to the orientation flatting processing to indicate the direction of crystallographic axis. Therefore, the segmented substrate sealing member (5*a* and 5*b*) and the segmented substrate support jig (4*a* and 4*b*) each are shaped asymmetric.

Numeral 14 denotes bolts made of Teflon, which exert an urging force on the substrate sealing member segments 5*a*, 5*b* after assembling the substrate support jig segments 4*a*, 4*b* and setting the crystalline silicone substrate 1 thereto. By screwing the bolts 14 completely, the entire circumference of the crystalline silicon substrate 1 and junction planes between the substrate support jig segments 4*a* and 4*b* are sealed from the electrolyte bodies 11*a*, 11*b*.

After the substrate support jig 4 is assembled, the support jig sealing member 15 made of Goatex is set on a groove in the circumference of the substrate support jig 4, and then the assembly is inserted into the formation tank 2, whereby the electrolyte bodies 11*a*, 11*b* can be separated from each other electrically and hermetically.

Here, the anode-side electrolyte 11*b* serves as a liquid electrode. Further, electrical barrier is made on a surface of the crystalline silicone substrate 1 facing the cathode-side electrolyte 11*a* due to the difference in work function between the electrolyte and the crystalline silicon substrate. Numeral 8 denotes the direction of a formation current.

Then, the external DC power source (not shown) supplies a current to form a cathode of the platinum electrode 3*a* and an anode of the platinum electrode 3*b*, whereby fluorine ions (hereinafter referred to simply as "$F^-$ ions") are generated in the electrolyte 11*a* in the formation tank 2. The $F^-$ ions react with silicon atoms on the cathode-side surface of the silicon wafer 1 to form tetrafluorosilicon ($SiF_4$) and hydrogen ($H_2$), whereby the silicon wafer 1 is dissolved while forming pores.

It is known that in the formation of pores by the anodization of crystalline silicon, the presence of holes in a silicon wafer plays an important role. The mechanism of pore formation is considered as follows.

First, when holes inside a degenerated p-type silicon reach the surface of silicon single crystal wafer, a $F^-$ ion starts nucleophilic attack on a Si—H bond compensating for a dangling bond of silicon on the surface, to form a Si—F bond instead.

Since a F atom has a Greater electronegativity than a Si atom, polarization induction occurs due to the thus bonded $F^-$ ion. Then, another Si—H bond on the surface is attacked by another $F^-$ ion to form another Si—F bond, whereby a $H_2$ molecule is produced and at the same time an electron is injected into the anode. Because of the polarization in the Si—H bond, the electron density in each of back bonds is lowered to make Si—Si bonds weaker.

These weakened bonds are attacked by HF or $H_2O$, so that the Si atom on the crystal surface forms $SiF_4$, which is released from the surface. The crystal surface is terminated by hydrogen or oxygen. A recess formed on the crystal surface by the release of a Si atom generates an electric field distribution which predominantly attracts holes, whereby the surface heterogeneity becomes enhanced thereby to form a pore along the direction of an electric field.

Generally speaking, the above-mentioned electrolyte is usually used in combination with alcohol. The added alcohol prevents hydrogen gas generated during the reaction from adhering to the surface, thus interfering with the supply of hydrofluoric acid to the surface, and in turn impeding the reaction. The above-mentioned predominant formation of pores also occurs in a degenerated n-type silicon in which holes are minority carriers. In this case, the formation of electron-hole pairs upon irradiation with light is a supply source of holes.

In the conventional anodization apparatus as described above, the crystalline silicon substrate 1 is arranged to effect electrical seal of the electrolyte throughout the entire circumference in the peripheral portion of the beveled side surface, so that the cathode-side surface of the crystalline silicon substrate 1 can be uniformly treated to form many pores.

Further, since the cross sectional structure of the apparatus is electrically symmetrical with respect to the crystalline silicon substrate 1, both surfaces of the crystalline silicon substrate 1 can be subjected to the pore-making treatment by inversion of the polarity of the voltage applied to the platinum electrodes *3a, 3b*.

Furthermore, in another example as shown in FIG. 10, a plurality of crystalline silicon substrates (*1a–1d*) are arranged in an electrically sealed state at certain intervals through substrate support jigs (*4a–4d*) as described above along the electric line of force of the formation current between the platinum electrodes *3a,3b*, whereby the plurality of crystalline silicon substrates can be subjected to the pore-making treatment at the same time.

In the conventional anodization apparatus, the electrolyte has a specific resistance of about 20Ω·cm and serves also as a liquid electrode. Further, since the anodization reaction proceeds by a potential difference due to the electric barrier between the cathode-side surface and the anode-side surface of the crystalline silicon substrate, it is needless to say that the formation tank and the substrate support jig except for the crystalline silicon substrate should be made of materials excellent in electric insulating properties.

Accordingly, very careful attention is required in assembling the substrate support jig to prevent the electrolyte from leaking through between the peripheral portion of the crystalline silicon substrate and the sealing member, or through the junction in the substrate support jig.

Particularly, in the case that the electrolyte leaks in the vicinity of the crystalline silicon substrate, a current path is formed through the electrolyte so as to lower the potential difference, whereby the anodization reaction does not proceed near the leakage portion to form a local nonporous region around the leakage portion.

Such an unevenness of the thickness of the porous silicon layer formed on the surface of the crystalline silicon substrate cannot be permissible in its applications to products and is a serious problem. In addition, from the industrial viewpoint, when a plurality of crystalline silicon substrates are subjected to the pore-making treatment at the same time, it is important to assure certain and easy support of the substrate and leakage prevention of the electrolyte.

However, since the conventional sealing member does not have a structure to seal the entire circumference in the peripheral portion on the side surface of the crystalline silicon substrate without a cut or parting, there is a possibility the electrolyte will leak through the junction portion in the substrate support jig in addition the problem of labor and time being required for mounting and dismounting the crystalline silicon substrate.

In summary, a problem to be solved is that there is no conventionally available supporting device for a silicon substrate, which fully meets the requirement of preventing the leakage of electrolyte by the treated substrate, to easily mount or dismount the treated substrate, to reduce a production cost, and to simplify the structure.

SUMMARY OF THE INVENTION

It is an object of the present invention to provide a supporting device for substrate having a simple structure, which can surely prevent the leakage of electrolyte by the treated substrate, to which the treated substrate can be easily mounted or dismounted, and which can be produced in a reduced production cost.

It is another object of the present invention to provide a supporting device for a treated substrate, applicable to a formation tank in which a chemical treatment is effected on a treated substrate supported in a treating solution, comprising:

a sealing member with elasticity for supporting said treated substrate in hermetic fit to a peripheral portion thereof except for a surface to be treated;

a substrate support jig for supporting said sealing member;

means for introducing a fluid of gas or liquid from the outside into a hollow portion in said substrate support jig so that a pressure of said fluid urges said sealing member against said peripheral portion except for the surface to be treated on said substrate to achieve hermetic fit therebetween; and means for changing said pressure to control a deformation amount of said sealing member and an urging force thereon.

It is another object of the present invention to provide an improved anodization apparatus provided with the above-mentioned supporting device.

It is a further object of the present invention to further improve members used in the supporting device for substrate or in the anodization apparatus.

DESCRIPTION OF THE PREFERRED EMBODIMENTS

Figure 1:
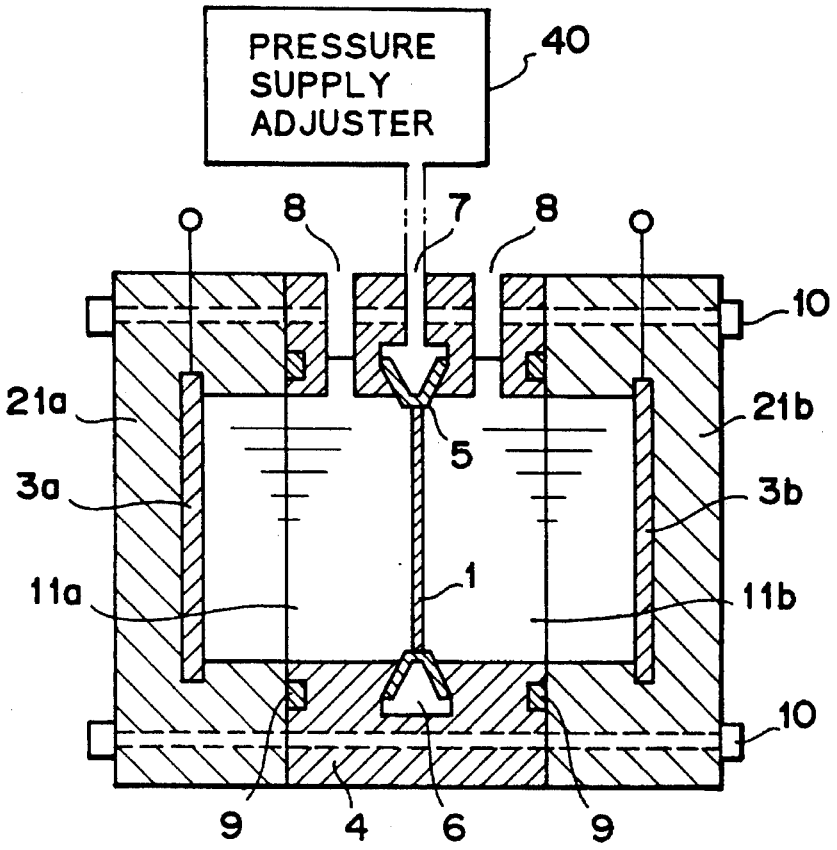
FIG. 1 is a schematic drawing to show an example of anodization apparatus according to the present invention.

A supporting device for treated substrate according to the present invention is applicable to a formation tank in which a chemical treatment is effected on a treated substrate supported in a treating solution, which comprises:

a sealing member with elasticity for supporting said treated substrate in hermetic fit to a peripheral portion thereof except for a surface to be treated;

a substrate support jig for supporting said sealing member;

means for introducing a fluid of gas or liquid from the outside into a hollow portion in said substrate support jig so that a pressure of said fluid urges said sealing member against said peripheral portion except for the surface to be treated on said substrate to achieve hermetic fit therebetween; and means for changing said pressure to control a deformation amount of said sealing member and the urging force thereon. An anodization apparatus according to the present invention is provided with the supporting device for treated substrate as described above.

In the present invention, an integral sealing member without a cut or parting throughout the entire circumference is used for hermetically sealing the peripheral portion of substrate around the entire circumference in close fit to the substrate, so that the treating solution can be positively prevented from leaking.

When the pressure is released, the inner diameter of the sealing member is slightly larger than the outer diameter of the treated substrate such as a crystalline silicon substrate; when the pressure is exerted, the inner size of the sealing member becomes perfectly coincident with or slightly smaller than the size of crystalline silicon substrate. Further, a deformation amount of the sealing member and an urging force thereon can be finely adjusted by adjusting the air or liquid pressure. Then the treated substrate can be supported without damage while surely preventing the solution from leaking.

Such a stretchable sealing member is set on the inner circumferential surface of the substrate support jig, which keeps its shape unchanged upon exertion of pressure, so that the sealing member can be repetitively used for setting, sealing and releasing crystalline silicon substrates one by one.

Another sealing means in the present invention employs a sealing member comprising a thin tube, which is reversibly or irreversibly heat-shrinkable.

The tubular sealing member has an inner diameter slightly larger than the outer diameter of crystalline silicon substrate. After the crystalline silicon substrate is inserted inside the tubular sealing member, it is heated to shrink in the normal direction to the crystalline silicon substrate thereby to achieve sealing therebetween.

In this case, the urging force of the sealing member can be finely adjusted by controlling an amount of shrinkage of the tubular sealing member depending upon the heating temperature and the heating time duration.

In case a plurality of crystalline silicon substrates having the same shape are set in a tubular sealing member, they are set and heated to shrink one by one in the sealing member.

Further, employing a stretchable sealing member, which is similarly tubular but has an inner diameter slightly smaller than the outer diameter of crystalline silicon substrate, the crystalline silicon substrate can be inserted inside the sealing member when the member is expanded, whereby sealing can be achieved by action of a shrinking force without relying on heat shrinkage.

Since the sealing members can seal the entire circumference of crystalline silicon substrate without a cut or junction, they are free of the leakage of electrolyte as observed in a junction in a substrate support jig in the conventional sealing member, and the crystalline silicon substrate can be readily mounted to or dismounted from either of the sealing members.

The present invention will be described in more detail with reference to the accompanying drawings.

Embodiment 1

FIG. 1 is a schematic cross section of an apparatus I in Embodiment 1 of the present invention. In FIG. 1, reference numeral 1 designates a crystalline silicon substrate as a substrate to be treated (treated substrate), 21*a* and 21*b* electrode support jigs made of a tetrafluoroethylene resin (trade name: Teflon), 3*a* and 3*b* platinum electrode plates to which a voltage is applied from an unrepresented external DC power source to constitute negative and positive electrodes, 4 a substrate support jig made of a tetrafluoroethylene resin (trade name: Teflon), constituting substrate supporting means, 5 a substrate sealing member made of a perfluoro elastomer rubber (trade name: Kemraz or Kalrez) similarly having flexibility, elasticity, hermetic property and chemical resistance, 6 a groove, in which the substrate sealing member 5 is set, for uniformly transmitting an air pressure or a liquid pressure onto the sealing member 5, using a space between them, and 7 a pressure supply port for supplying the air or liquid pressure from an external pressure supply system 40 into the space (hollow portion) formed between the groove 6 and the substrate sealing member 5. Numeral 8 denotes outlets for discharging gas generating during pore formation. Numeral 9 denotes formation tank sealing members made of a tetrafluoroethylene resin (trade name: Goatex) having flexibility, elasticity, chemical resistance and hermetic property for preventing an electrolyte from leaking through joint planes between the electrode support jigs 21*a*, 21*b* and the substrate support jig 4, and 10 bolts for fixing the electrode support jigs 21*a*, 21*b* and the substrate support jig 4 to each other. Numerals 11*a* and 11*b* represent the electrolyte, which is a hydrofluoric acid mixture solution.

Figure 2A:
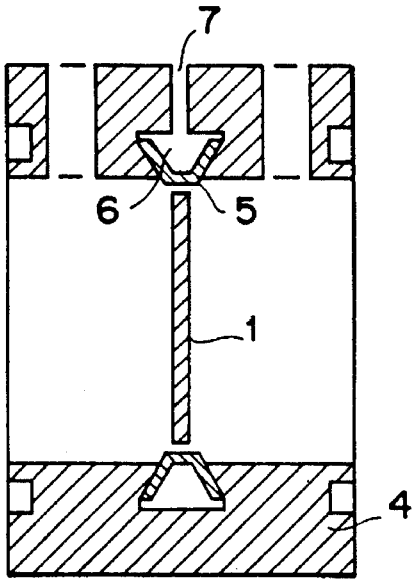
FIG. 2A PRIOR ART
FIGS. 2A and 2B are schematic drawings to illustrate a method for supporting a substrate in the anodization apparatus shown in FIG. 1.

FIG. 2A is a cross section to illustrate a positional relation immediately before the crystalline silicon substrate 1 is set in the substrate support jig 4 of the present invention as shown in FIG. 1 or immediately after the setting condition is released. Since FIG. 2A shows a state in which the air or liquid pressure is released, the inner diameter of substrate sealing member 5 is larger than the outer diameter of crystalline silicon substrate 1. In this state the crystalline silicon substrate can freely pass inside the substrate sealing member.

Figure 2B:
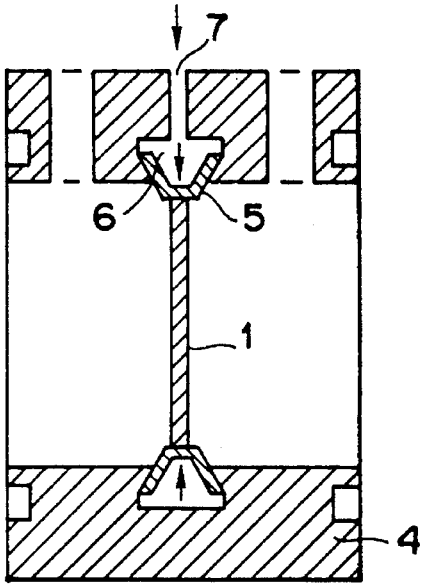
FIG. 2B PRIOR ART

FIG. 2B is a cross section to illustrate a state in which the crystalline silicon substrate 1 is set. In FIG. 2B, when the air or liquid pressure is supplied from the pressure supply port 7, the pressure urges the substrate sealing member 5 along a taper of groove 6 in the normal direction to the crystalline silicon substrate 1 to project the member out of the groove 6. In FIG. 2B, arrows represent a direction of deformation of the substrate sealing member 5. The taper formation in the substrate sealing member 5 and the groove 6 is preferable for hermetically sealing the air or liquid pressure or for preventing a positional deviation of the substrate sealing member 5 relative to the crystalline silicon substrate upon projecting out of the groove. The substrate sealing member is made of a perfluoro elastomer rubber (trade name: Kemraz) having an elongation of 200% at the room temperature.

In the present apparatus I of the invention the pore-making treatment is carried out as follows on the crystalline silicon substrate. First, a p-type (100) crystalline silicon is produced by the CZ (Czochralski) method as doped with boron (B) to provide a resistivity of 0.01 to 0.02 Ωcm. Then a wafer is obtained by orientation-flat processing of the thus produced p-type crystalline silicon in diameter 125 mm and thickness 0.6 mm. The wafer is used as the crystalline silicon substrate 1.

Pressure applying means applies compressed air in pressure of 2 kgf/cm$^2$ from a compressor (not shown) in the pressure supply adjuster 40 in FIG. 1. The substrate sealing member 5 has the shape similar to that of the used crystalline silicon substrate 1, but the sealing member 5 has an aperture with inner diameter in a state free of the pressure of compressed air, 2 mm larger than the outer diameter of silicon substrate 1 so that the crystalline silicon substrate 1 may pass freely through the sealing member 5. The sealing member 5 has a straight portion corresponding to the orientation flat portion of crystalline silicon substrate 1, and the straight portion has the same length of 42.5 mm as that of substrate.

When the crystalline silicon substrate 1 is set in the substrate support jig 4, an unrepresented vacuum chuck jig first sucks and supports a flat surface of crystalline silicon substrate 1 in the state that the pressure of compressed air is released, and then locates it in the center of substrate sealing member 5.

Then the compressed air is applied to the substrate sealing member 5 to deform it in the normal direction to the substrate. The pressure supply adjuster 40 adjusts the pressure to keep the substrate sealing member 5 in hermetic fit to the entire circumference of crystalline silicon substrate 1. While the pressure is maintained, the vacuum of the vacuum chuck jig is removed.

In this state, the substrate support jig 4 uniformly supports the crystalline silicon substrate 1 to assure hermetic seal for electrolyte.

The electrode support jigs 21*a* and 21*b* are connected to the both ends of substrate support jig 4 through the formation tank sealing members 9 and the assembly is secured by the bolts 10.

Two electrically independent formation cells are formed by the substrate support jig 4, the crystalline silicon substrate 1, and the electrode support jigs 21*a*, 21*b*.

A hydrofluoric acid mixture solution, in which 48 wt % (% by weight) pure-water-diluted hydrofluoric acid, pure water and alcohol are mixed at a ratio of 1:1:1, is poured into the cells through the outlets 8 to form a body of cathode-side electrolyte 11*a* and a body of anode-side electrolyte 11*b*. The hydrofluoric acid mixture solution has a resistivity of 23.6 Ωcm.

A DC constant-current source (not shown) supplies a current at current density of 8 mA/cm$^2$ to each of platinum electrodes 3*a* and 3*b*.

The formation reaction starts with the current flow to form pores on the crystalline silicon substrate 1 from the cathode electrode 3*a* side surface to the anode-side surface. Gas such as hydrogen produced in the pore-making treatment is discharged out of the formation cells through the outlets 8.

After a porous silicon layer is formed in a desired thickness, the direct current is stopped and the electrolyte is discharged through the outlets 8. Then pure water is poured into the formation cells to wash the crystalline silicon substrate 1.

The pure water is then discharged and thereafter the bolts 10 are unscrewed to separate the electrode support jigs 21*a*, 21*b* and the substrate support jig 4, disassembling the formation tank.

The crystalline silicon substrate 1 is then supported by the vacuum chuck (not shown) and the compressed air applied onto the substrate sealing member 5 is released. The substrate sealing member 5 having elasticity restores its original shape to free the crystalline silicon substrate 1.

According to the above process, a reaction for about twelve minutes formed a porous silicon layer in thickness of 10 μm. In a surface of crystalline silicon substrate with diameter 125 mm, the thickness distribution of porous silicon layer was such that the thickness was 10 μm at the center of substrate and 11 to 12 μm in the peripheral portion of substrate.

The thus produced porous silicon had a percentage of pores P (Porosity) of 55%.

In a comparative example using the conventional sealing method, if leakage of electrolyte took place due to an imperfect seal, the porous silicon layer was not formed at the leaking portion, though the formation reaction occurred at a certain distance from the leaking portion. The porous silicon layer was first formed with a thickness of 10 μm in the region outside a circle with a radius of 40 mm about the leaking portion.

Figure 11:
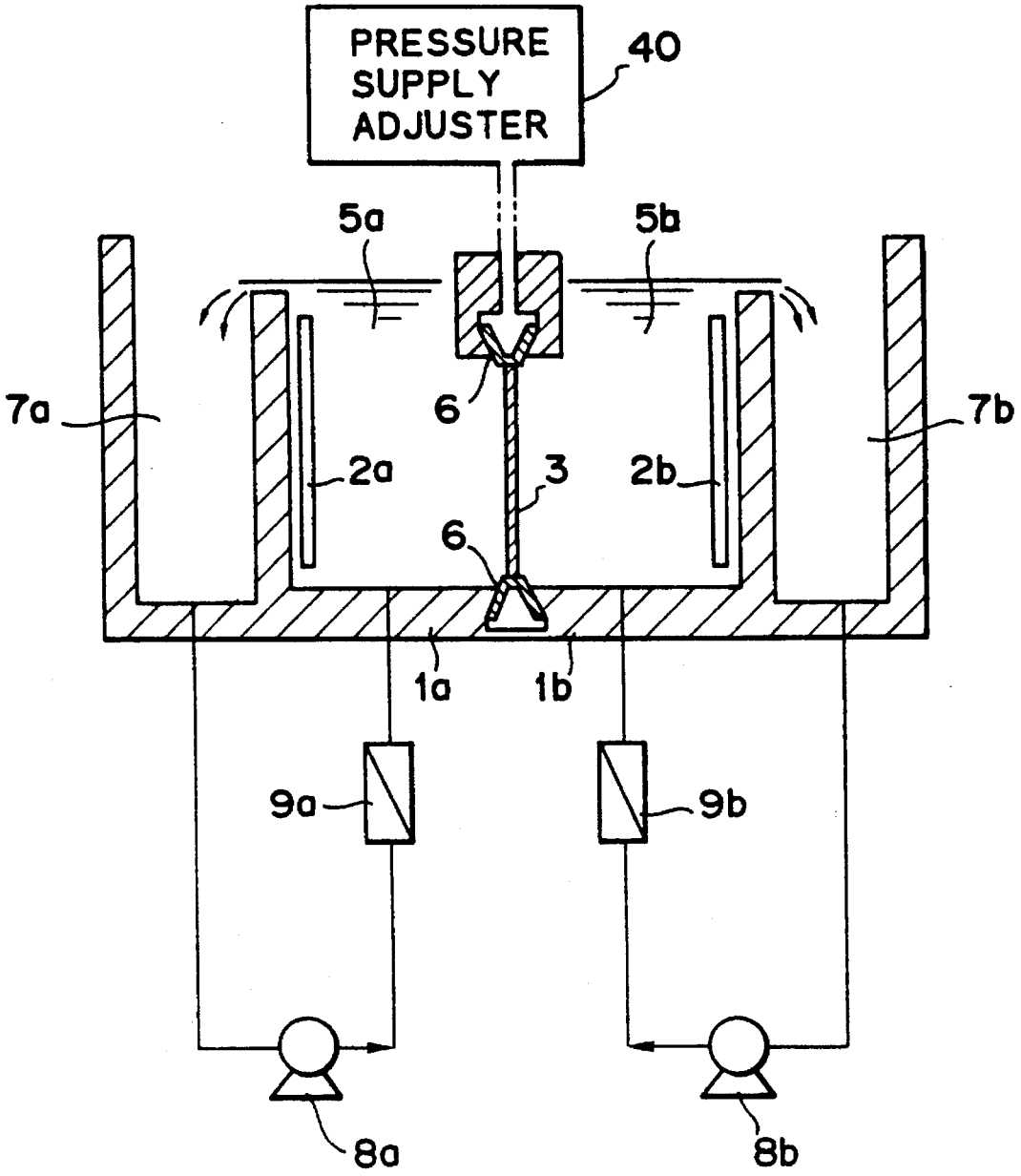
FIG. 11 is a schematic drawing to show another example of anodization apparatus.

The anodization apparatus of the present invention may be so arranged that the electrolyte overflows the formation cells. FIG. 11 shows an example of such anodization apparatus.

In FIG. 11, reference numerals 1*a*, 1*b* designate formation cells which can keep the liquid surface of electrolyte above the highest portion of the treated substrate, 2*a*, 2*b* denote platinum electrodes, 3 a silicon wafer as a treated substrate, 5*a*, 5*b* HF aqueous solution as electrolyte, 6 a wafer holder made of Teflon, and 40 an adjuster for supplying pressure to the wafer holder. Numerals 7*a*, 7*b* are overflow tanks for receiving the overflowing solution, and 8*a*, 8*b* denote pumps as electrolyte supply means.

In this apparatus, the pumps 8*a*, 8*b* circulate the electrolyte in the formation cells.

The electrolyte in the formation cell 1*a* on the treated surface side of treated substrate overflows the upper wall of formation cell 1*a* into the overflow tanks 7*a*, 7*b*. The overflow tanks 7*a*, 7*b* formed around the formation cell 1*a* are arranged to be connected to each other, and the overflowing solution thereinto is circulated by the pump 8*a* to the formation cell 1*a*. In this occasion, bubbles in the electrolyte are discharged from the upper surface of the solution and particles are efficiently discharged into the overflow tanks upon overflow to be then removed by filter 9*a*, 9*b* set in pipes in the circulation system.

In the apparatus shown in FIG. 11, the electrolyte is supplied to the overflow tanks and then cleaned, so that attachment of particles or bubbles may be reduced to the porous surface of treated substrate, enabling more uniform chemical treatment.

In the present invention, a conductive bulkhead (such as a wafer) for preventing metal contamination may be provided between the treated substrate and the positive metal electrode in order to avoid direct contact between the electrolyte and the positive metal electrode. In such an arrangement, the metal is prevented from dissolving into the electrolyte, thus preventing metal contamination on the treated substrate.

Also, an arrangement can be employed in the present invention that the hermetic contact between the treated substrate and the sealing member is achieved by a sealing member arranged obliquely to the main surface of treated substrate and urged against the peripheral portion thereof.

Further, the present invention permits one of the electrodes to be set on the back surface of the treated substrate.

Figure 12:
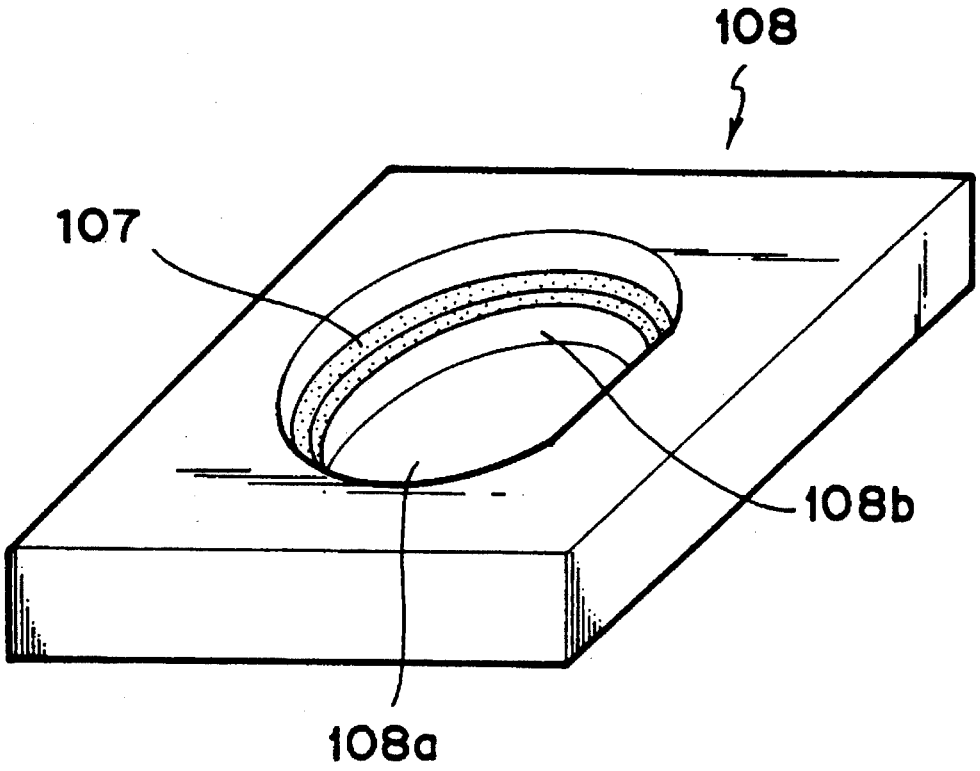
FIG. 12 is a schematic drawing to show a carrying cassette for treated substrate.

In addition, the treated substrate (such as wafer) can be effectively transported in the present invention, using a cassette for carrying the treated substrate as shown in FIG. 12.

In FIG. 12, a wafer cassette 108 is formed as a plane-plate member, in which an aperture 108*a* shaped to fit the contour of a wafer as the treated substrate is formed in the central portion. A step 108*b* is formed on the lower portion of inner wall in the aperture 108*a* as a support portion for supporting the peripheral edge of wafer set in the aperture 108*a*. The step 108*b* is integrally formed throughout the entire circumference of inner wall in the aperture 108*a*. A wafer seal 107 is provided as a sealing member on the upper surface of the step 108*b* throughout the entire circumference thereof, and a wafer is mounted on this wafer seal 107.

In the present invention, using the treated substrate carrying cassette shown in FIG. 12, the treated substrate can be efficiently transported or mounted to the anodization apparatus or to a semiconductor process system.

Embodiment 2

Five sets of substrate support jigs 4 as used in Embodiment 1 of the present invention are provided and intervals between crystalline silicon substrates 1 are arranged to be 50 mm. Then, a plurality of substrates are subjected to an anodization treatment at the same time in a formation tank which has the same structure as in Embodiment 1 of the present invention except that the substrates are arranged along the formation current between the platinum electrodes.

The formation conditions are the same as in Embodiment 1 except that the applied voltage is increased in order to allow the same amount of formation current to flow.

The thickness of the porous silicon layer was from 10 to 11 μm in the center of the five crystalline silicon substrates after anodization.

Embodiment 3

In Embodiments 1 and 2 of the present invention as described, the substrate support jig 4 utilized deformation of the substrate sealing member 5 by compressed air. However, if there is no need to reuse the substrate support jig, the structure can be further simplified.

Figure 3:
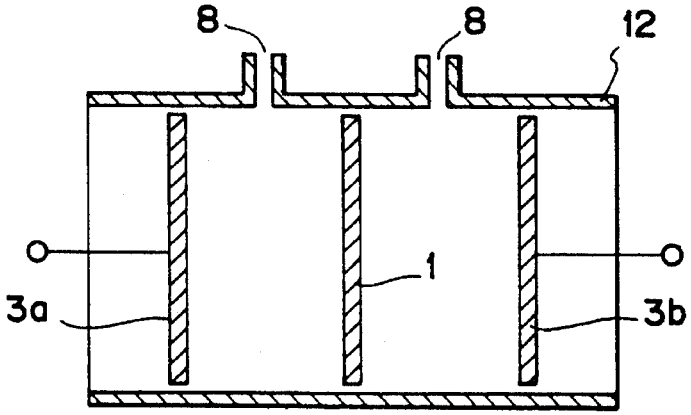
FIG. 3 PRIOR ART
FIG. 3 is a schematic drawing to show another example of anodization apparatus.

FIG. 3 is a schematic cross section of a third embodiment of the present invention.

In FIG. 3, reference numeral 1 denotes a crystalline silicon substrate, and 3*a*, 3*b* platinum electrode plates. Numeral 12 denotes a heat-shrinkable tube made of a tetrafluoroethylene resin (Trade name: Teflon) and numeral 8 denotes outlets.

Figure 4:
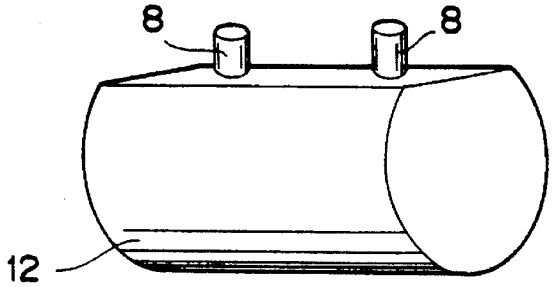
FIG. 4 PRIOR ART
FIG. 4 is a schematic drawing to show a heat-shrinkable tube used in the apparatus shown in FIG. 3.
Figure 5:
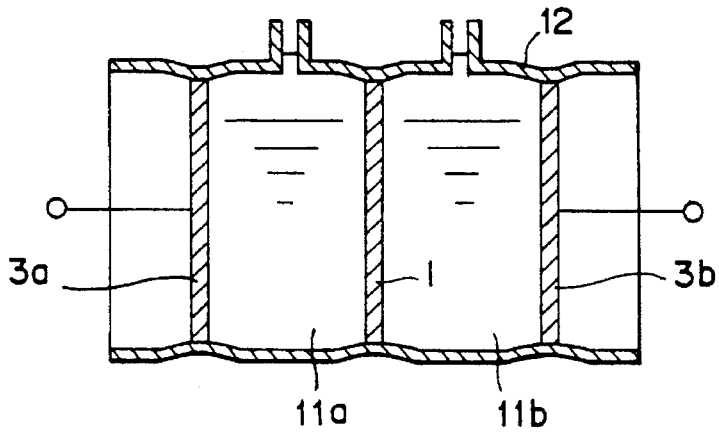
FIG. 5 PRIOR ART
FIG. 5 is a schematic drawing to illustrate a state that a treated substrate and the electrodes are supported in the apparatus shown in FIG. 3.

The outer diameter of the crystalline silicon substrate 1 used is 125 mm as in Embodiment 1. The thickness of the heat-shrinkable tube 12 is 0.2 mm. Its cross-sectional shape is shown in FIG. 4. The tube has an inner diameter 2 mm larger than the outer diameter of the used crystalline silicon substrate and a flat portion with the same length as that of the orientation flat portion of a wafer, as in Embodiments 1 and 2 of the present invention. The shape and the size of the platinum electrode plates 3*a*, 3*b* are the same as those of the crystalline silicone substrate 1. Thus, the platinum electrode plates and the crystalline silicon substrate have sizes such that they are movable inside the heat-shrinkable tube 12.

The platinum electrode plates 3*a*, 3*b* and the crystalline silicon substrate 1 are inserted one by one into the heat-shrinkable tube 12 to be set at 50 mm intervals. After the platinum electrode plates and the crystalline silicon substrate are put in place supported by an unrepresented fixing jig through the wall of the heat-shrinkable tube 12, the heat-shrinkable tube 12 is heated to 177° C. to shrink it thereby. The heat-shrinkable tube used in the present apparatus II of the invention has a heat shrinkage factor of 77% at the heating temperature, which is sufficient to cover the size difference between the tube and the crystalline silicone substrate.

The heating is continued until the heat-shrinkable tube 12 is hermetically fitted around the entire circumference of the crystalline silicon substrate 1 and platinum electrode plates 3*a*, 3*b*. After completion of the heat shrinkage, the fixing jig is removed.

By the above operation, two formation cells, which are electrically separated from each other, are formed in the heat-shrinkable tube 12 in a simple structure.

Then, an electrolyte is poured into the cells through the outlets 8 and a direct current is made to flow through the platinum electrode plates 3*a*, 3*b*, to start the pore-making treatment on the crystalline silicon substrate. Since the heat-shrinkable tube is high in electric insulating properties and the outside of the heat-shrinkable tube is insulated by air, there is no leakage of direct current as long as the sealing is complete.

Further, the whole heat-shrinkable tube may be immersed in a liquid having high electric insulating properties, for example in pure water. This is particularly useful as safety measure to prevent the platinum electrode plates 3*a*, 3*b* from being taken off due to the hydraulic pressure of the electrolyte.

However, attention should be paid to prevent the pure water from flowing through the outlets 8 into the formation cells and thereby to keep the mixture ratio of the electrolyte unchanged.

Since the heat-shrinkable tube is transparent, one can confirm or observe not only the supporting and sealing conditions of the crystalline silicon substrate but also the state of the substrate surface and the inside of the formation cells during anodization.

After completion of the treatment, the electrolyte is discharged as in the above embodiments.

Here, the shrinkage of the heat-shrinkable tube utilizes an irreversible deformation with heat. It is thus difficult to utilize the heat deformation again for taking the crystalline silicon substrate and the platinum electrode plates out of the tube. Therefore, the heat-shrinkable tube must be cut to take them out.

Embodiment 4

Next described is a method for supporting a substrate using the shrinking force of an elastic tube which has been expanded.

Figure 6:
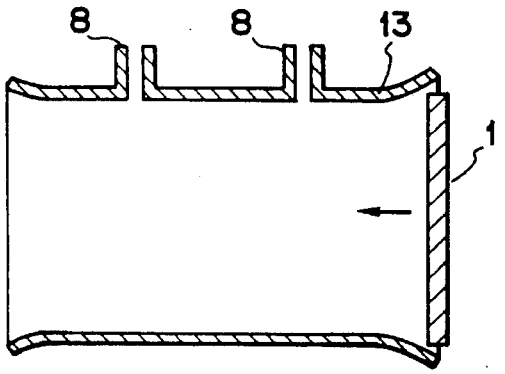
FIG. 6 PRIOR ART
FIG. 6 is a schematic drawing to show another example of anodization apparatus.

FIG. 6 shows a schematic cross section of an apparatus according to a fourth embodiment of the present invention.

In FIG. 6, reference numeral 1 denotes a crystalline silicon substrate as used in Embodiments 1–3 of the present invention, and 13 an elastic tube made of a perfluoro elastomer rubber (trade name: Kemraz) having an inner diameter slightly smaller than the outer diameter of the crystalline silicon substrate 1. The elongation of the tube is 200% and the thickness is 2 mm.

Since the tube can change its shape freely, the cross-sectional shape may be circular.

The inner diameter of the both end apertures of elastic tube 13 is made larger than the outer diameter of the crystalline silicon substrate in order to facilitate insertion of the crystalline silicon substrate 1 into the tube. Numeral 8 denotes outlets.

Figure 7:
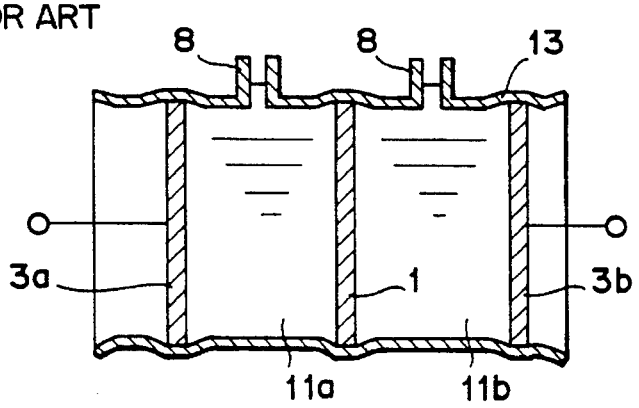
FIG. 7 PRIOR ART
FIG. 7 is a schematic drawing to illustrate a state that a treated substrate and the electrodes are supported in the apparatus shown in FIG. 6.
Figure 8:
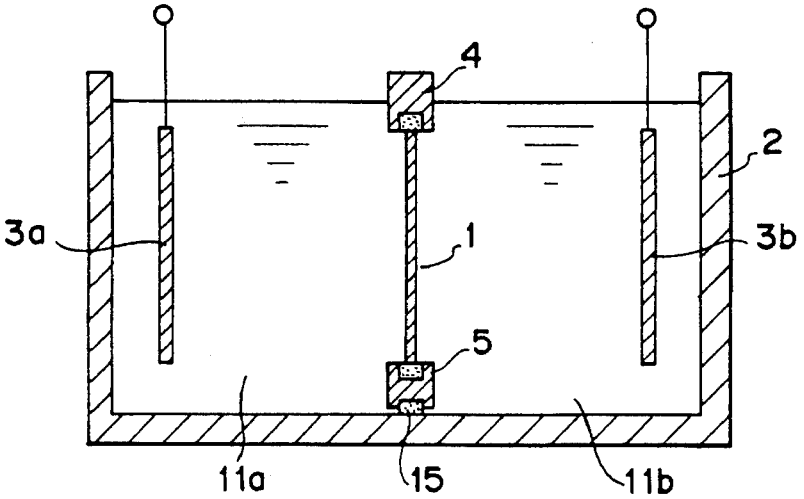
FIG. 8 is a schematic drawing to show the structure of a conventional anodization apparatus.
Figure 9A:
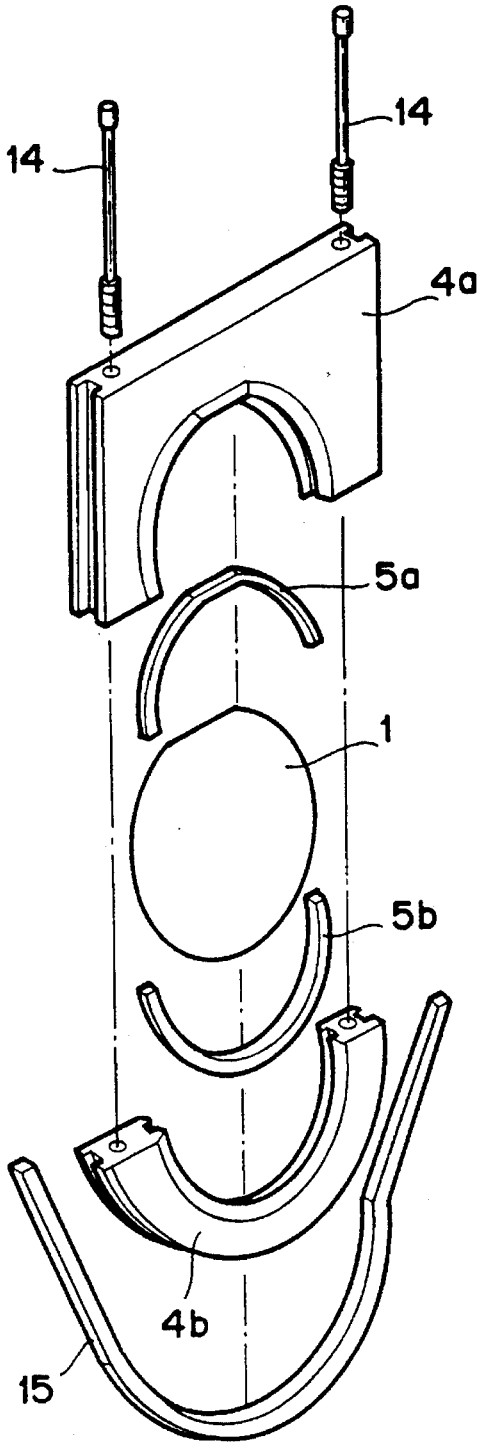
FIG. 9A is a perspective view to show constituent elements in a conventional substrate support jig.
Figure 9B:
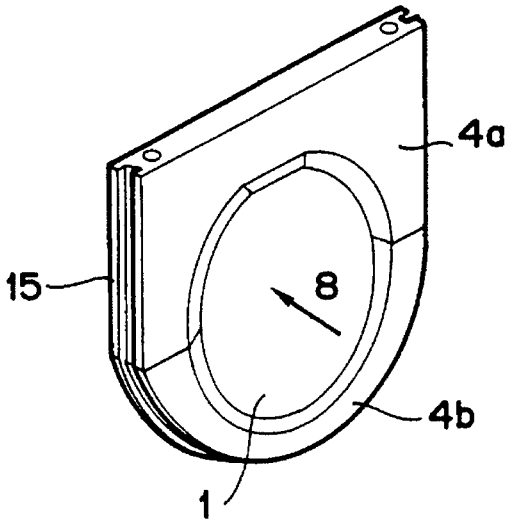
FIG. 9B is a perspective view to show an assembled state of the conventional substrate support jig shown in FIG. 9A.
Figure 10:
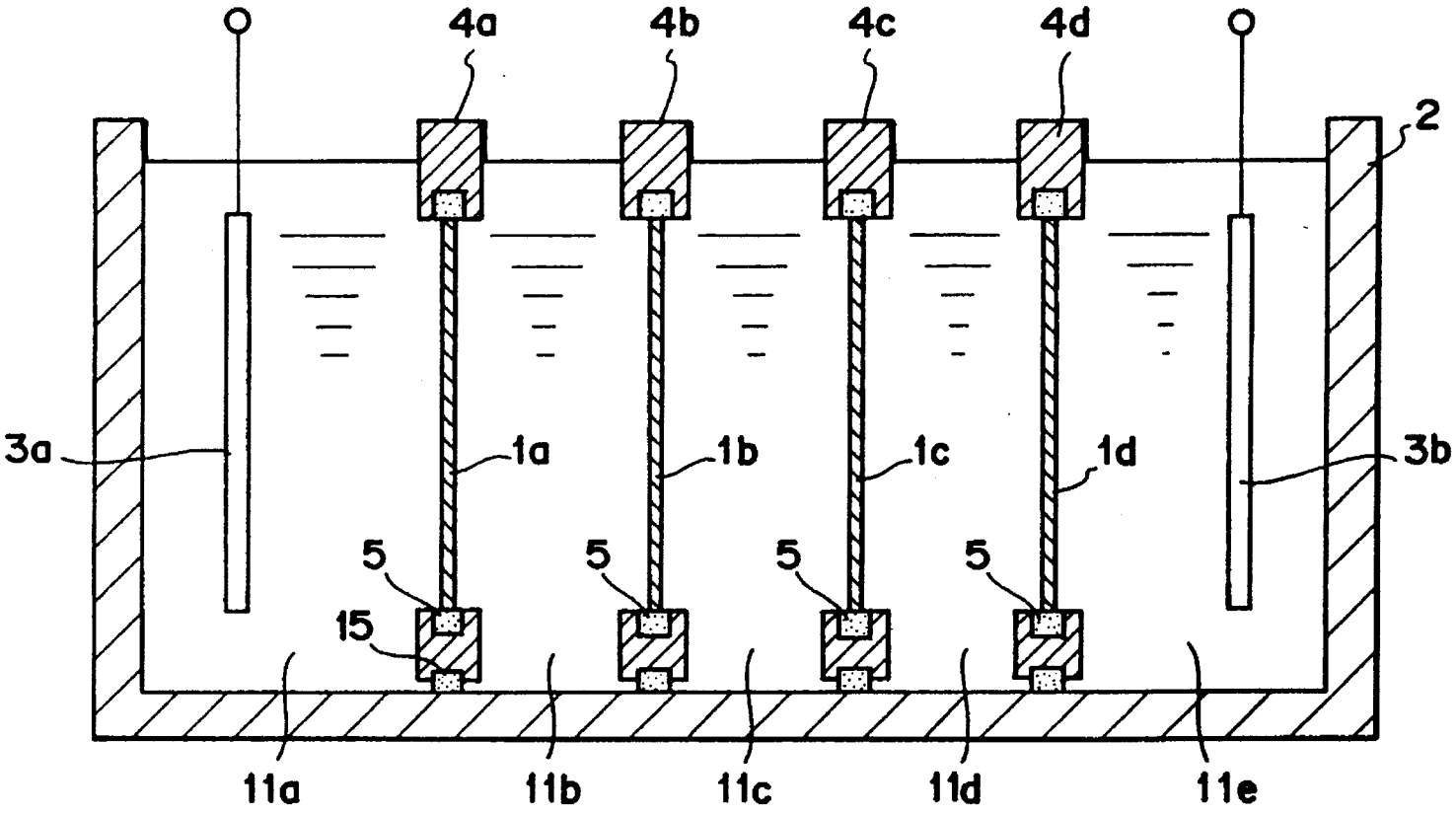
FIG. 10 is a schematic drawing to show a conventional anodization apparatus for treating a plurality of substrates.

Further, FIG. 7 is a schematic cross section showing a state in which the platinum electrodes 3*a*, 3*b* and the crystalline silicon substrate 1 are set and supported inside the elastic tube 12.

The platinum electrodes 3*a*, 3*b* and the crystalline silicon substrate 1 are supported one by one by a vacuum chuck (not shown) and then consecutively inserted into the elastic tube 13 as expanded.

In this occasion, the elastic tube 13 is likely to shrink so as to restore its original shape, whereby it hermetically fits to the entire circumferences of the platinum electrodes and the crystalline silicon substrate and thereby support them.

Then, an electrolyte is poured into the cells through the outlets 8 and a direct current is made to flow through the platinum electrodes to start the anodization reaction.

After completion of the pore-making treatment on the crystalline silicon substrate 1, the electrolyte is discharged.

Next, in the reverse order to the above insertion operation, the platinum electrodes 3*a*, 3*b* and the crystalline silicon substrate 1 are supported one by one by the vacuum chuck (not shown) and then consecutively pulled out from the end of the elastic tube 13 to the outside.

After taking the crystalline silicon substrate and the platinum electrodes 3*a*, 3*b* out, the elastic tube 13 restores its original size before the insertion. Thus, it can be used again.

Also as in case of the third embodiment, the apparatus may be immersed in pure water during the anodization in order to cancel the liquid pressure of the electrolyte, as described in the present apparatus II.

Instead of the elastic tube, an elastic plate having the same opening can be used in the present invention, though such an embodiment is not shown in a drawing. In this case, the elastic plate is closely sandwiched and supported between Teflon plates having the same opening.

In the above embodiments, there is no limitation of the size of the crystalline silicon substrate as long as the size matches the deformation amount of substrate support jig and a substrate support jig for exclusive use is provided. Thus, the shape of substrate is not limited to a disk.

Further, the shape of the treated substrate is not limited to a plate, but may be spherical or cubic with an anodization area limited thereon.

Furthermore, the apparatus of the present invention can be used for formation reactions other than the pore-making treatment on the crystalline silicon substrate as long as the type and the mixture ratio of electrolyte are properly selected.

Yet furthermore, a part of the sealing methods in the present invention can be readily used for sealing other liquid or gas materials than the electrolyte of the present invention.

As detailed above, the present invention can provide a supporting device for a substrate having a simple structure, which is able to prevent the leakage of treating solution, which is easy in mounting or dismounting the treated substrate and which can be produced at a low cost, because the device is so arranged that the treated substrate is hermetically sealed and supported under pressure throughout the entire circumference. Particularly, the anodization apparatus of the invention enjoys an effect of uniform treatment on the treated substrate.

What is claimed is:

1. An anodization apparatus for anodizing the surface of a semiconductor substrate by supporting the semiconductor substrate between a pair of electrodes in an electrolytic solution and applying a voltage across the pair of electrodes, said anodization apparatus comprising:

an elastic sealing member for supporting a peripheral portion of the semiconductor substrate such that a surface portion of the semiconductor substrate remains exposed;

a substrate support jig which includes a tapered hollow portion for supporting said sealing member; and means for introducing a fluid of gas or liquid into the tapered hollow portion so that said sealing member is pressed against and brought into hermetic contact with the tapered hollow portion and with the entire peripheral portion of the semiconductor substrate by the pressure of the fluid, whereby the electrolytic solution is separated into electrically isolated parts by the semiconductor substrate, said sealing member, and said substrate support jig.

2. The anodization apparatus according to claim 1, wherein said sealing member is an integrally formed member.

3. The anodization apparatus according to claim 1, wherein the electrolytic solution is circulated.

4. The anodization apparatus according to claim 3, wherein the electrolytic solution is circulated by a pump.

5. The anodization apparatus according to claim 3, wherein the electrolytic solution is arranged to overflow a tank which houses the electrolytic solution.

6. The anodization apparatus according to claim 3, wherein the electrolytic solution is circulated through a filter.

7. The anodization apparatus according to claim 1, wherein the electrolytic solution is arranged to flow in a direction parallel to the surface of the semiconductor substrate.

8. The anodization apparatus according to claim 1, further comprising a conductive bulkhead provided between an electrode and the semiconductor substrate.

* * * * *